US006120353A

United States Patent [19]

Suzuki et al.

[11] Patent Number: 6,120,353

[45] Date of Patent: Sep. 19, 2000

[54] POLISHING METHOD FOR SEMICONDUCTOR WAFER AND POLISHING PAD USED THEREIN

[75] Inventors: Kiyoshi Suzuki; Hisashi Masumura; Teruaki Fukami, all of Nishishirakawa-gun, Japan

[73] Assignee: Shin-Etsu Handotai Co., Ltd., Tokyo, Japan

[21] Appl. No.: 09/248,993

[22] Filed: Feb. 12, 1999

[30] Foreign Application Priority Data

Feb. 12, 1919 [JP] Japan ..... 10-044244

[51] Int. Cl.[7] ..... B24B 1/00

[52] U.S. Cl. ..... 451/41; 451/526; 451/533

[58] Field of Search ..... 451/41, 59, 526, 451/534, 533, 550, 921

[56] References Cited

U.S. PATENT DOCUMENTS

| | | | |
|---|---|---|---|
| 3,653,859 | 4/1972 | Zimmer, Jr. et al. | 451/533 |
| 3,867,798 | 2/1975 | Howard | 451/548 |
| 4,555,250 | 11/1985 | Horie et al. | 451/41 |
| 5,007,128 | 4/1991 | Englund et al. | 451/533 |
| 5,036,629 | 8/1991 | Ishikuro et al. | 451/57 |
| 5,185,964 | 2/1993 | Englund et al. | 451/36 |
| 5,290,606 | 3/1994 | Hestevik et al. | 451/39 |
| 5,369,916 | 12/1994 | Jefferies et al. | 451/533 |
| 5,396,737 | 3/1995 | Englund et al. | 451/36 |
| 5,573,453 | 11/1996 | Tiefenbach, Jr. | 451/534 |
| 5,692,950 | 12/1997 | Rutherford et al. | 451/41 |
| 5,821,167 | 10/1998 | Fukami et al. | 438/691 |
| 5,827,395 | 10/1998 | Masumura et al. | 156/345 |

FOREIGN PATENT DOCUMENTS

788146 A1 8/1997 European Pat. Off. .

OTHER PUBLICATIONS

WPI Abstract, Abstract of Japanese Publication No. JP 22–50776, Oct. 8, 1990.

*Primary Examiner*—M. Rachuba

*Attorney, Agent, or Firm*—Evenson, McKeown, Edwards & Lenahan, P.L.L.C.

[57] ABSTRACT

In a polishing method for a semiconductor wafer in which polishing slurry is interposed between the semiconductor wafer and a polishing pad and the semiconductor wafer is mirror-polished by a polishing step for planarization, when polishing is conducted using a suede-like foam urethane resin polishing pad having physical properties of low compressibility lower than 9 % and high pore density equal to or higher than about 150 pores/cm$^2$ as the polishing pad used in the polishing step, a mirror silicon wafer with good surface roughness of 50 bits in haze can be manufactured.

4 Claims, 2 Drawing Sheets

Fig. 2

| SPECIMEN NO. | PORE DENSITY (PORES/$cm^2$) | COMPRESSIBILITY (%) | SURFACE ROUGHNESS (HAZE)(BITS) |
|---|---|---|---|
| 1 | 108.4 | 5.3 | 64 |
| 2 | 109.3 | 6.3 | 68 |
| 3 | 105.5 | 8.3 | 69 |
| 4 | 103.5 | 10.1 | 65 |
| 5 | 130.2 | 5.1 | 61 |
| 6 | 126.4 | 6.1 | 62 |
| 7 | 135.8 | 8.1 | 61 |
| 8 | 129.1 | 9.4 | 63 |
| 9 | 158.4 | 5.2 | 45 |
| 10 | 149.2 | 5.9 | 44 |
| 11 | 152.6 | 8.3 | 45 |
| 12 | 160 | 10 | 64 |
| 13 | 198.4 | 4.8 | 39 |
| 14 | 236.1 | 6 | 40 |
| 15 | 210.5 | 8.5 | 44 |
| 16 | 241.6 | 11.1 | 62 |

POLISHING METHOD FOR SEMICONDUCTOR WAFER AND POLISHING PAD USED THEREIN

BACKGROUND OF THE INVENTION

1. Field of the Invention

The present invention relates to a polishing method for conducting mirror-polishing of a semiconductor wafer based on a mechano-chemical polishing method and particularly, to a polishing method for a semiconductor wafer in which the semiconductor wafer is mechano-chemically polished by a polishing step for planarization and improvement of surface roughness, wherein a polishing pad in the polishing step is improved and thereby micro-roughness, especially micro-roughness called haze is improved, and a polishing pad used in the polishing method.

2. Description of the Prior Art

Generally, a manufacturing process of a semiconductor wafer comprises a slicing step of slicing a single crystal ingot to obtain a thin disk like wafer, a chamfering step of chamfering the outer periphery of the wafer in order to prevent the wafer obtained in the slicing step from breakage or chipping, a lapping step of flattening the wafer, an etching step of removing a damaged region remained in the surface and edges of the wafer after the chamfering and lapping, a mirror-polishing step of obtaining a mirror surface of the wafer and a cleaning step of cleaning the polished wafer to eliminate attached polishing slurry and other foreign matter from the wafer.

The mirror-polishing step for a wafer uses a polishing pad and aqueous polishing slurry which is produced in such a manner that abrasive particles such as $SiO_2$ base fine particles or the like are suspended in an aqueous weak alkaline solution, wherein the wafer is polished by means of a so-called mechano-chemical polishing method (a mechanical, chemical composite method). In the mechano-chemical polishing method, a dynamic action of mechanical polishing and a chemical action of etching are combined and a synergetic effect in combination of the actions results in achievement of a mirror surface of a wafer to excellent precision with high efficiency, in which characteristics in polishing of a wafer are largely affected by a balance between a mechanical factor and a chemical factor in polishing.

In other words, in a initial stage of the polishing step, the mechanical factor acts on a wafer so strongly that a high degree of flatness is realized on the surface of a wafer with high efficiency, while in a final stage, the mechanical factor is reduced and mirror-polishing is conducted so that surface roughness is improved, that working damages are eliminated and that excellent precision is attained.

In such a conventional polishing method, polishing is performed in a plurality of stages: for example, in the three stages; polishing goes in combination of first polishing, second polishing and finish polishing.

A conventional polishing method have been conducted as follows: In the first and second polishing stages, colloidal silica is used as abrasive particles in polishing slurry and polishing pad of a non-woven cloth type is used. A relative speed between the wafer and the polishing pad is set to 100 m/min and a pressure on the wafer is set to 500 g/cm$^2$ with results that a flattening operation is almost completed and a flatness of about 0.3 $\mu$m is secured in a final part of the first polishing stage, whereas a surface roughness remains still to be about 1 nm in the final part. Thereafter, the second polishing is conducted while changing a particle size of colloidal silica with results that the wafer of a flatness about 0.3 $\mu$m and a surface roughness about 0.5 nm are attained.

Then, finish polishing is conducted in conditions of a standard polishing pressure of 340 g/cm$^2$ and a low relative speed of 40 m/min using polishing slurry including colloidal silica as in the preceding stages and a polishing pad of a suede type with results of flatness of about 0.3 $\mu$m, surface roughness of about 0.35 nm and a haze level of about 50 bits. A surface roughness at this level has a correlation with a haze level of the same specimen which is obtained from measurement of light scattering intensity, whereby a surface condition of a wafer can be evaluated by investigating a haze level thereof.

The applicant of the present invention has provided a two-staged wafer polishing method whereby a quality equal to that obtained by the three-staged polishing method above described can be secured (see the published Unexamined Japanese Patent Application No. Hei 9-38849).

Such a prior art is conducted in such a manner that the plurality of stages in a polishing step includes a first polishing stage and a finish polishing stage. In the course of polishing step, a relative speed and a pressure are changed: in a final part of the first polishing stage, rapid acceleration to a relative speed two to four times as fast as an actual one in the running and rapid reduction to a pressure ½ to 1/10 time as high as an actual one in the running; and in a final stage of the finish polishing stage, an actual relative speed in the running is rapidly reduced to a relative speed ½ to ⅕ times as fast as the actual one.

In recent years, a trend toward a thinner oxide film in company with progress to higher integration in a device design has been advanced and it has been suggested that the surface roughness exerts an influence on an oxide film breakdown voltage, especially time dependent dielectric breakdown (TDDB) characteristics. Accordingly, while stable supply of wafers each with good surface roughness has become important, there is a fault in the above described polishing conditions that, when a polishing pad of a different production lot is used (when a polishing pad already in use is replaced with a new one still in the same polishing conditions), surface roughness of a wafer is sometimes deteriorated thanks to the replacement. A cause for the deterioration in surface roughness is conceived a change in a physical property of a polishing pad.

Therefore, in order to secure stable supply of wafers each with good surface roughness, it is necessary to effect an incoming inspection of polishing pads, especially polishing pads for use in a finish polishing stage and use only polishing pads each with good physical properties for polishing a silicon wafer.

However, it has, heretofore, not been known what physical properties exert influences on surface roughness and accordingly, it has been difficult to set criteria for an incoming inspection for a polishing pad to be used in finish polishing, which has in turn made stable supply of silicon wafers each with good surface roughness difficult.

SUMMARY OF THE INVENTION

The present invention has been made in light of such a problem. It is accordingly an object of the present invention is to solve the problem by determining physical property items and their respective critical values of a finish polishing pad required for attaining a silicon wafer with good roughness on its mirror surface; and conducting polishing while using a finish polishing pad selected according to the physical property items and their respective critical values.

The inventors of the present invention have made it clear as a result of serious studies based on experiments and the like that a silicon wafer with good roughness on its mirror surface can be attained by polishing the wafer in a finish polishing stage using a finish polishing pad whose pore density on the pad surface (hereinafter simply referred to as pore density) is high and whose compressibility is low. Besides, it has been apparent that the surface roughness is dramatically improved when finish polishing is conducted using a finish polishing pad with pore density equal to or high than a value and compressibility equal to or lower than a value.

To be concrete, as shown in aspects of the present invention, it is preferred to use a finish polishing pad with pore density equal to or higher than about 150 pores/$cm^2$ and compressibility lower than 9% and it is more preferred to use a finish polishing pad with pore density equal to or higher than about 190 pores/$cm^2$ and compressibility lower than 7%.

That is, the present invention is directed to a polishing method for a wafer in which polishing slurry is interposed between the semiconductor wafer and a polishing pad and the semiconductor wafer is in a mechano-chemical manner mirror-polished by a polishing step for planarization, wherein the polishing pad used in the polishing step has physical properties of compressibility lower than 9% and pore density equal to or higher than about 150 pores/$cm^2$.

When a silicon wafer is subjected to polishing, especially finish polishing, using the polishing pad, the silicon wafer with good roughness (haze level) on its mirror surface can be manufactured.

It is preferred to, especially as the polishing pad, use a foam resin polishing pad, especially a suede-like foam urethane resin polishing pad stuck on a base member made of non-woven cloth or foam resin.

A finish polishing pad of the present invention is used in a finish stage of multi-staged polishing. However, there is no limitation on the number of times wafers are polished in stages preceding the finish polishing and only by use of the finish polishing pad in final finish polishing, a wafer, especially, with a haze level of 50 bits or lower can be attained.

The haze is a fine surface roughness which causes light scattering under light beams from a collector and such light scattering is measured by LS-6000 (made by Hitachi Electronics Engineering Co.) by which the haze is expressed as a proportional value in bits as a unit shown in voltage converted from a light scattering intensity. Measurement was conducted at a haze mode detecting voltage of 900 V in the measurement instrument.

BRIEF DESCRIPTION OF THE DRAWINGS

FIG. 2 is a table showing measured values of surface roughness of mirror silicon wafers when polishing was conducted on the silicon wafers using finish polishing pads with various values respectively of pore density and compressibility, wherein numeral marks in the figures indicate respective constituents of the apparatus to which the present invention is applied as follows: 11 indicates a polishing head, 12 a wafer, 13 a polishing turn table, 14 a polishing pad, 14A a base member and 16 polishing slurry.

DETAILED DESCRIPTION OF THE PREFERRED EMBODIMENT

Below, an preferred embodiment of the present invention will exemplarily be detailed in reference to the accompanying drawings. However, it is to be noted that dimensions and shapes of constituent parts described in the embodiment, relative positions thereof and the like are not intended to limit the scope of the present invention to the description of the embodiment unless otherwise specified, but the description should rather be construed for the purpose of illustration only.

Figure 1A:
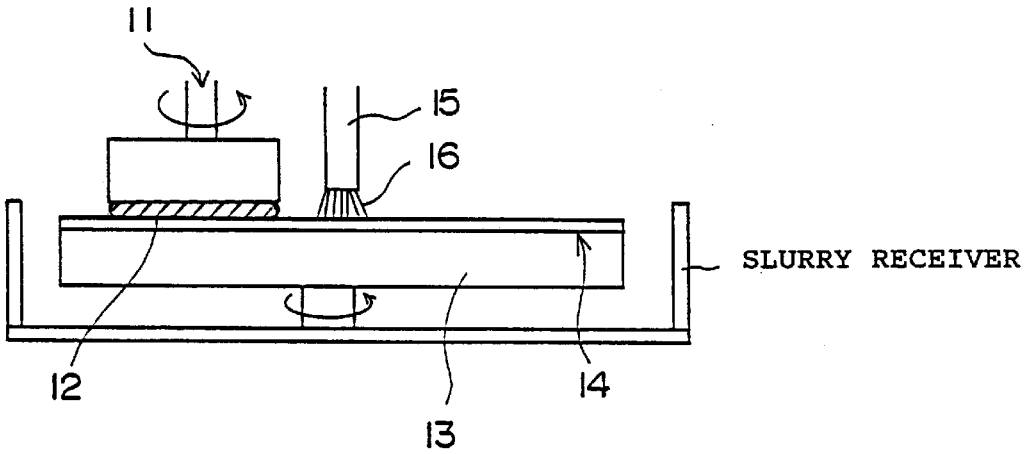
FIG. 1(A) is a side elevational view showing an outline of a polishing apparatus for a multi-staged wafer polishing method to which the present invention is applied.

FIG. 1(A) shows an embodiment of a multi-staged wafer polishing method to which the present invention is applied and is a side elevational view showing an outline of a polishing apparatus. The polishing apparatus comprises: a polishing turn table 13 and a polishing head 11 which are respectively rotated in directions of arrows, wherein a polishing pad 14 is stuck on a polishing turn table 13, a wafer 12 is mounted in a polishing head 11, polishing slurry 16 in the state of slurry is supplied into a gap between the wafer 12 and the polishing pad 14 stuck on a base member 14A from a slurry supply pipe 15, and a relative speed is produced between the wafer 12 and the polishing pad 14 with the polishing slurry 16 interposed therebetween, whereby polishing by a mechano-chemical polishing method is realized through frictional movement among the wafer, the polishing slurry 16 and the polishing pad 14, which reside on or under the lower surface of the wafer 12.

Figure 1B:
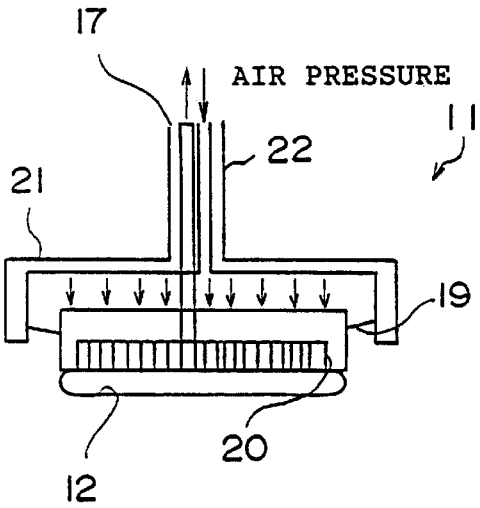
FIG. 1(B) is a longitudinal sectional view showing a polishing head with a suction plate and a wafer and FIG. 1(C) is an enlarged sectional view of a polishing pad.

The polishing head 11, as shown in FIG. 1(B), comprises: a ceramic suction plate 20 holding the wafer 12 by a suction force from a vacuum line 17; and a head body 21 in the shape of a disk cover which presses the wafer 12 to the polishing pad 14 side by a pressure supplied from a rear side of the suction plate 20, wherein the head body 21 and the suction plate 20 are, in a freely swaying manner, coupled by a rubber member 19 and pressure air is supplied in a closed space on the rear side of the suction plate 20 from a cylindrical portion 22.

In the embodiment, a two-staged polishing step comprising first polishing and finish polishing was adopted, and the first polishing used a polishing pad 14 of a non-woven cloth type and a solution which was prepared by suspending colloidal silica in an aqueous weak alkaline solution exerting a chemical action on a wafer. When a planarization in a final part of a flattening polishing operation which had a mechanical filing effect as a main effect under a high polishing pressure was completed, a balance in combination between a mechanical factor and a chemical factor was properly adjusted and a relative speed was rapidly accelerated so as to quickly activate a chemical action. Then, a rapid reduction in a polishing pressure to a low value was effected in a little time lag from the rapid acceleration and thereby not only are soluble products removed from the surface of the wafer without any damage in the surface, but the planarization was achieved without any direct frictional action on the wafer surface while the soluble products were removed.

In the finish polishing, finish polishing pads with values of pore density and compressibility shown in FIG. 2 and an aqueous weak alkaline solution as a polishing slurry in which colloidal silica as abrasive particles was suspended were used and a mechano-chemical polishing method was applied. Mechanical polishing conditions were a standard relative speed of 50 m/min and a standard polishing pressure of 300 g/cm$^2$. Under such conditions, polishing with priority given to the chemical factor is conducted, wherein a chemical reaction induced by a mechanical energy at a contact point between a $SiO_2$ fine particle and the wafer is utilized to mirror-polish the wafer and the silicon wafers were polished for about 10 min and thereafter wafers were evaluated on surface roughness of each of mirror surfaces thereof.

In this case, compressibility was measured in conformity with JIS L-1096. Actually, a public known automatic compressibility measuring instrument was used and the measurement procedures comprise the following steps of: measuring a thickness T1 of a specimen when one minute of an initial load L0 (800 g/cm$^2$) has been elapsed; measuring a thickness T2 of the specimen when another one minute of a second load L1 (1880 g/cm$^2$) has been elapsed from the same time as completion of the first measurement; and then calculating a compressibility of the specimen based on the following equation.

$$\text{Compressibility } (\%)=\{(T1-T2)/T1\}*100.$$

Pore density was measured based on observation using a public known SEM (Scanning Electronic Microscope) by 50 magnifications, wherein the number of pores in a unit area (cm$^2$) was counted.

Figure 1C:
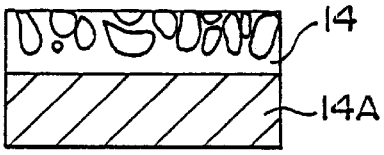

A finish polishing pad 14 which was used in the finish operation is, as shown in FIG. 1(C), for example, suede finish pads made of foam urethane resin each with a thickness of 0.5 mm to 3 mm stuck on base members 14A each of a thickness about several mm made of non-woven cloth.

Evaluation of wafers, after the finish polishing was conducted, on micro-roughness (surface roughness) called haze using LS-6000 made by Hitachi Electronics Engineering Co. Measurement was conducted at a detecting voltage of 900 V in a haze mode. The haze is expressed in bits as unit, wherein as a bit value is smaller, surface roughness is better.

The results are shown in FIG. 2. FIG. 2 is measurements of surface roughness (haze) of mirror surfaces of the silicon wafers when the silicon wafers were polished using finish polishing pads 14 which had respectively various values of pore density and compressibility.

As can be understood from the table, when values of pore density are equal to or higher than about 150 pores/cm$^2$ but values of compressibility are higher than about 9%, measured values of surface roughness are about 60 bits (specimen No. 12, 16). On the contrary, when values of compressibility are lower than 9% but values of pore density are lower than about 150 pores/cm$^2$, measured values of surface roughness are about 60 bits (specimen 1, 2, 3, 5, 6, 7). Polishing pads, conventionally, have not been controlled on values of compressibility and pore density and thereby, the polishing pads were in such non-controlled states of the values.

On the other hand when values of pore density are equal or higher than about 150 pores/cm$^2$ and values of compressibility are equal to or lower than about 9%, values of surface roughness are improved by a great margin and assume 45 bits (specimen No. 11, 10, 9, 15). When polishing pads with higher values of pore density and lower values of compressibility as compared with those described above were used, values of surface roughness were 40 bits, but when polishing pads with values of pore density equal to or higher than 190 pores/cm$^2$ and values of compressibility lower than 7%, constant values of surface roughness are obtained (specimen No. 13, 14).

In other words, it is understood that a polishing pad 14 having pore density equal to or higher than about 150 pores/cm$^2$ and compressibility lower than 9% is preferably used in the present invention and a polishing pad 14 having pore density equal to or higher than about 190 pores/cm$^2$ and compressibility lower than 7% or is more preferably used in the present invention. It is conceived that when the compressibility is smaller, uneven distribution of working spots between a wafer surface and a polishing pad is corrected to an even state and when pore density is increased, a capability of a pad to hold polishing slurry is improved.

As described above, according to the present invention, when physical property items and their critical values of a finish polishing pad required for attaining a silicon wafer with good roughness on its specular surface are determined and polishing of a silicon wafer is conducted using a finish polishing pad selected based on the physical property items and their critical values, then silicon wafers each with good roughness on its mirror surface: haze equal to or lower than 50 bits, can be manufactured in a stable manner.

In the mean time, a polishing pad of the present invention is used in a finish stage of multi-staged polishing and polishing stages prior to the finish polishing are not specifically restricted in any way. When a polishing pad of the present invention is used, especially, in a final finish polishing stage, a wafer with good haze level lower than 50 bits can be attained.

We claim:

1. A polishing method for a semiconductor wafer (12) in which polishing slurry (16) is interposed between the semiconductor wafer (12) and a polishing pad (14) and the semiconductor wafer (12) is mirror-polished by a polishing step for planarization and improvement of surface roughness, wherein the polishing pad (14) used in the polishing step has physical properties of low compressibility lower than 9% and high pore density equal to or higher than about 150 pores/cm$^2$.

2. A polishing method for a semiconductor wafer (12) according to claim 1, wherein the polishing pad (14) is a foam resin polishing pad (14) stuck on a base member (14A) made of non-woven cloth or foam resin.

3. A polishing pad (14) used in a mirror-polishing step of a semiconductor wafer (12) for planarization and improvement of surface roughness, wherein the polishing pad (14) has physical properties of low compressibility lower than 9% and high pore density equal to or higher than about 150 pores/cm$^2$.

4. A polishing pad (14) used in a mirror-polishing step of a semiconductor wafer (12) according to claim 3, wherein the polishing pad (14) is a foam resin polishing pad (14) stuck on a base member (14A) made of non-woven cloth or foam resin.

* * * * *